US011486228B2

(12) United States Patent
Mackay

(10) Patent No.: US 11,486,228 B2
(45) Date of Patent: Nov. 1, 2022

(54) RESETTABLE TOE VALVE

(71) Applicant: DOWNHOLE PRODUCTS LIMITED, Aberdeen (GB)

(72) Inventor: Alexander Craig Mackay, Aberdeen (GB)

(73) Assignee: DOWNHOLE PRODUCTS LIMITED, Portlethen (GB)

( * ) Notice: Subject to any disclaimer, the term of this patent is extended or adjusted under 35 U.S.C. 154(b) by 173 days.

(21) Appl. No.: 16/975,536

(22) PCT Filed: Apr. 11, 2019

(86) PCT No.: PCT/IB2019/053005
§ 371 (c)(1),
(2) Date: Aug. 25, 2020

(87) PCT Pub. No.: WO2019/207398
PCT Pub. Date: Oct. 31, 2019

(65) Prior Publication Data

US 2020/0408068 A1 Dec. 31, 2020

(30) Foreign Application Priority Data

Apr. 23, 2018 (GB) ..... 1806561

(51) Int. Cl.
*E21B 34/14* (2006.01)
*E21B 34/10* (2006.01)
(Continued)

(52) U.S. Cl.
CPC ..... *E21B 34/142* (2020.05); *E21B 34/103* (2013.01); *E21B 34/063* (2013.01); *E21B 34/08* (2013.01); *E21B 2200/06* (2020.05)

(58) Field of Classification Search
CPC .... E21B 34/142; E21B 34/103; E21B 34/063; E21B 34/08; E21B 2200/06; E21B 2200/04
See application file for complete search history.

(56) References Cited

U.S. PATENT DOCUMENTS 9,121,252 B2 9/2015 George
2014/0262325 A1* 9/2014 Castro ..... E21B 34/14 166/374

(Continued)

OTHER PUBLICATIONS

UK Search Report for Application GB1806561.5 dated Jun. 15, 2018.

(Continued)

*Primary Examiner* — Christopher J Sebesta

(57) ABSTRACT

A toe valve to control the injection of fluid into a toe of an oil or gas well and including: a body with a bore, the body having a port adapted to permit fluid flow between the bore and an outlet on an external surface of the toe valve when the port is open; a closure member adapted to move from an initial closed position in which the port is closed, to an open position in which the port is open; and an actuating mechanism which can be actuated to urge the closure member from the initial closed position toward the open position, and which can be reset when the closure member is moving between the closed and open positions to return the closure member to the initial closed position.

16 Claims, 4 Drawing Sheets

(51) Int. Cl.
*E21B 34/06* (2006.01)
*E21B 34/08* (2006.01)

(56) References Cited

U.S. PATENT DOCUMENTS

| | | | | |
|---|---|---|---|---|
| 2016/0177667 | A1 | 6/2016 | Kellner | |
| 2017/0096878 | A1* | 4/2017 | Anton | E21B 34/10 |
| 2017/0268313 | A1 | 9/2017 | Harris | |
| 2018/0334882 | A1* | 11/2018 | Brandsdal | E21B 33/1208 |
| 2019/0195048 | A1* | 6/2019 | Tveranger | E21B 34/14 |

OTHER PUBLICATIONS

AADE-13-FTCE-25, Chauffe, "Hydraulic Toe Valve Specifically Designed for a Cemented Environment" (2013).

SPE 167170, Canning et al, "Innovative Pressure-Actuated Toe Sleeve Enables True Casing Pressure Integrity Test and Stage Fracturing While Improving Completion Economics in Unconventional Resources" (2013).

* cited by examiner

RESETTABLE TOE VALVE

BACKGROUND OF THE DISCLOSURE

Field of the Disclosure

The present disclosure generally relates to a resettable toe valve.

Description of the Related Art

U.S. Pat. No. 9,121,252 discloses an apparatus and method for providing a time delay in injection of pressured fluid into a geologic formation. In one aspect the invention is a toe valve activated by fluid pressure that opens ports after a predetermined time interval to allow fluid to pass from a well casing to a formation. The controlled time delay enables casing integrity testing before fluid is passed through the ports. This time delay also allows multiple valves to be used in the same well casing and provide a focused jetting action to better penetrate a concrete casing lining.

US 2016/0177667 discloses an actuator for a downhole tool includes first, second, and third sleeves. The first sleeve obstructs a first port in a body of the downhole tool when the first sleeve is in a first position. The third sleeve obstructs a second port in the body when the third sleeve is in a first position, and the second and third sleeves are in one-way engagement with one another. A biasing member is positioned between the first sleeve and the third sleeve. The first sleeve is configured to move from the first position and toward the third sleeve in response a pressure communicated through the first port. When the pressure is reduced after the first sleeve is moved toward the third sleeve, the biasing member forces the first sleeve back toward the first position, which causes the third sleeve to permit fluid communication through the second port.

US 2017/0096878 discloses a smooth bore toe valve including a first sub defining a through bore and a fluid flow path through a wall thereof; a second sub; a housing mechanically engaged with the first and second subs to define a valve cavity axially between the first and second subs and to define a chamber radially between the first and second subs and the housing, the housing further defining a plurality of openings in a wall thereof; and a sleeve disposed within the chamber between the housing and the first and second subs to close the openings and, upon application of fluid pressure horn the through bore through the fluid flow path, open the openings to fluid flow from the valve cavity to the exterior of the housing. A method for using such a valve is also disclosed.

US 2017/0268313 discloses a tool including a housing between an outer wall and an inner wall that surrounds a longitudinal tool bore. First and second axially spaced ports connect the housing to the tool bore. An unlocking piston seals across the first port and an arming sleeve seats across the second port. A locking ring is held in place by a retaining ring and prevents the arming sleeve from sliding towards the unlocking piston to open the second port. An unlocking tool bore pressure at the first port moves the unlocking piston axially to displace the retaining ring and unlock the tool. A lower, arming tool bore pressure moves the arming sleeve in the unlocked tool to open the second port and arms the tool. An actuating tool bore pressure, which is less that the unlocking pressure, actuates a valve piston via the open second port.

AADE-13-FTCE-25 discloses the field trial, testing and results of a toe initiation sleeve designed specifically for a cemented environment. There are no moving parts on either the inside or outside of the valve. With three layers, including the patented inner piston, only the middle layer moves, differentiating it from previous tools. This particular feature allows the tool to function regardless of any residual or tail cement left in the casing. Additionally, the tool allows for higher operating pressures and temperatures than other tools.

SPE 167170 discloses a pressure-actuated toe sleeve, which can eliminate running TCP on CT or perforating guns on E-line for initiating a flow path but still allows a casing pressure test to be run. Additionally, the pressure-actuated toe sleeve enables this casing test to be completed without having to exceed the casing test pressure to establish the flow path.

SUMMARY OF THE DISCLOSURE

According to the present disclosure, there is a provided a toe valve to control the injection of fluid into a toe of an oil or gas well, the toe valve comprising a body with a bore, the body having a port adapted to permit fluid flow between the bore and an outlet on an external surface of the toe valve when the port is open; a closure member adapted to move from an initial closed position in which the port is closed, to an open position in which the port is open; and an actuating mechanism which can be actuated to urge the closure member from the initial closed position toward the open position, and which can be reset when the closure member is moving between the closed and open positions to return the closure member to the initial closed position.

The actuating mechanism can thus optionally reverse the direction of movement of the closure member from a first direction moving towards the open position from the closed position to a second direction opposite to the first direction moving towards the closed position, i.e. away from the open position.

Optionally the actuating mechanism can return the closure member to the initial closed position, ready to be moved once more towards the open position, i.e. in some examples, the closure member can reach the initial closed position before it is actuated again, but in some examples the closure member can be actuated again after being reset to move back towards the open position without actually reaching the initial closed position.

Optionally the actuating mechanism can be reset at any point on the stroke of the closure member between the closed and open configurations. Optionally the actuating mechanism can be reset as many times as is required, e.g. ten or twenty times.

Optionally the actuating mechanism is actuated by fluid pressure, e.g. by a fluid pressure differential acting on the closure member and is optionally reset by fluid pressure, optionally by a fluid pressure differential acting on the closure member e.g. in the opposite direction. Optionally the actuating mechanism comprises a fluid circuit for fluid applying the pressure differential, and fluid is optionally recycled within the fluid circuit during actuation and reset cycles. Optionally the fluid circuit has an actuation flowpath and a reset flowpath, which are optionally connected in parallel. Optionally the fluid circuit is sealed. Optionally the fluid circuit comprises a flow restrictor acting on the actuation flowpath. Optionally the fluid circuit comprises a flow rate restrictor acting on the actuation flowpath, which can be disposed upstream of the flow restrictor, and which can optionally be set to permit slow flow rates through the actuation flowpath, but to close in the event of the flow rate of the fluid increasing beyond a threshold. Optionally during actuation fluid can only flow through the actuation flowpath.

Optionally the fluid circuit comprises a non-return valve acting on the reset flowpath and which is optionally bypassed by the actuation flowpath during actuation. Optionally the resistance to fluid flow in the circuit during the actuation flowpath is significantly greater than the resistance to fluid flow during the reset flowpath, optionally by $10^3$-$10^4$ times as much or more. Optionally during reset cycles, fluid can flow through both reset and actuation flowpaths, but since the resistance to fluid flow through the actuation flowpath is very much higher than the reset flowpath, most of the return flow passes through the reset flowpath rather than the actuation flowpath. Hence fluid flows (returns) through the circuit relatively quickly during reset cycles, and flows relatively slowly during actuation cycles, permitting rapid resetting of the valve, and a controllable prolonged delay for actuation with sufficient time for performance of pressure tests. An example of forward flow may be 0.25 l/m in using test pressure (e.g. 340 bar) and the return flow may be 2 l/min using the pressure generated by the return spring (e.g. 20 bar). In the event of a pressure test identifying a leak, the actuating mechanism can be rapidly reset while leaks are sealed and the actuating mechanism can be once more actuated thereafter, and this can happen as many times as is required.

Optionally the toe valve has a closed configuration in which the closure member is in the closed position (and is optionally static), an open configuration in which the closure member is in the open position (and is optionally static), and a stroking configuration when the closure member is between the open and closed configurations (and is optionally moving).

The body optionally has an axis, and the bore is optionally co-axial with the axis.

Optionally the port is closed when the closure member is moving between the open and closed positions; optionally the port is normally closed unless the closure member is in the open position.

Optionally the closure member is moved by pressure differentials, optionally across the closure member. Optionally the pressure differentials are applied by fluid pressure in the bore, which is increased above a threshold to move the closure member. Optionally the bore pressure is applied to the fluid circuit, and the pressure in the fluid circuit is applied to the closure member. The closure member can comprise a sleeve, which slides in the body in response to pressure differentials across the sleeve. Optionally, the sleeve is sealed within an annular cavity in which the sleeve can slide axially e.g., the second chamber. Optionally fluid flows through an opening in the bore when the sleeve is in the open position, and optionally the opening in the bore is covered by the sleeve, which is optionally sealed within the annular cavity on opposite sides of the opening in the closed position of the closure member. Optionally the sleeve is sealed on its outer surface.

Optionally the toe valve has a locked configuration, in which the closure member is held in a static position, optionally in the initial closed position. Optionally the closure member is held in the static position in the locked configuration by means of at least one locking device, optionally at least one shear pin or other frangible element, optionally resisting movement of the closure member from the closed position. Optionally the at least one locking device is adapted to release the closure member from the closed position when urged by the actuating mechanism, optionally in response to a pressure increase in the bore of the toe valve, which optionally exceeds a threshold pressure. Optionally the toe valve is held in the locked configuration during preparatory running in and cementing operations. Optionally the pressure threshold required to disrupt the locking device is lower than the pressure test threshold.

Optionally the body of the toe valve comprises an inner wall and an outer wall. Optionally the inner wall surrounds the bore of the toe valve and the outer surface of the outer wall comprises the external surface of the toe valve. Optionally the inner wall comprises an inner mandrel of the toe valve. Optionally the inner wall and outer wall define a recess between them, optionally an annular recess. Optionally the recess comprises at least one chamber. Optionally the at least one chamber is annular. Optionally the at least one chamber extends axially along the body.

Optionally the outer wall is formed from a separate casing or housing, optionally a sleeve, to the inner mandrel of the toe valve. Optionally different portions of the outer wall are formed from more than one separate casing or housing, which are optionally assembled with the body of the toe valve. Optionally the toe valve is assembled by sliding the at least one separate casing or housing over the outer surface of the inner mandrel. Optionally at least two casings or housings radially overlap each other on the outer surface of the inner mandrel.

Optionally the inner wall comprises at least one aperture between the bore of the toe valve and a first chamber. Optionally the inner wall comprises at least one aperture between the bore of the toe valve and a second chamber. Optionally the outer wall comprises at least one aperture between the second chamber and an external surface of the toe valve. Optionally the first and second chambers are axially spaced apart. Optionally at least one (typically each) of the apertures in the inner wall and outer wall is fitted with an excluder device, optionally a rubber membrane, optionally a burst disk.

Optionally the first chamber contains an actuating device, optionally a sleeve, optionally a piston, which is optionally part of the actuating mechanism. Optionally the piston may be stepped or multi-staged such that the bore pressure applied through the apertures to the back end of the piston transmits a reduced pressure into the actuation fluid. Optionally the actuating device is movable axially within the first chamber, optionally from a first position to a second position. Optionally the actuating device has at least one seal on an outer surface, and optionally at least one seal on an inner surface, which are optionally annular seals, which optionally make a fluid-tight seal against the inner surface of the first chamber. Optionally the actuating device divides the first chamber into at least two sealed cavities. Optionally at least one aperture in the inner wall between the bore of the toe valve and the first chamber permits fluid communication between the bore and a first sealed cavity of the first chamber.

Optionally the second chamber contains the closure member, which is optionally a sleeve, optionally a piston. Optionally the closure member is movable axially, optionally within the second chamber. Optionally the closure member has at least one seal on an outer surface, and optionally at least one seal on an inner surface, which are optionally annular seals, which optionally make a fluid-tight seal against the inner surface of the second chamber. Optionally the closure member divides the second chamber into at least two sealed cavities. Optionally at least one aperture in the inner wall between the bore of the toe valve and a sealed cavity of the second chamber, and the at least one aperture in the outer wall between the sealed cavity of the second chamber and an external surface of the toe valve, permit fluid flow between the bore and an outlet on an external surface of the toe valve. Optionally the closure member moves between the closed and open positions under fluid pressure, optionally from fluid flowing from the first chamber to the second chamber.

Optionally the first and second chambers are in fluid communication with each other. Optionally the second sealed cavity of the first chamber and the sealed cavity of the second chamber are in fluid communication with each other. Optionally the second sealed cavity of the first chamber and the sealed cavity of the second chamber contain a fluid, optionally a hydraulic fluid, optionally an oil. Optionally fluid can flow in both directions between the first chamber and the second chamber. Optionally fluid flows between the first and second chambers through fluid channels formed between the surfaces of at least one separate casing or housing which forms the first and second chambers. Optionally the fluid channels contain sealing devices, optionally seals, optionally annular seals, which restrict fluid flow to specific regions. Optionally the resistance to fluid flow from the first chamber to the second chamber is greater (optionally significantly greater) than resistance to fluid flow from the second chamber to the first chamber, for example, flow rates from the first chamber to the second are typically 0.1% or less (e.g. 0.05-0.02%, or even less than 0.02%) of the flow rates of fluid from the second chamber to the first. The restricted flow rate from first to second and relatively unrestricted return flow can be set at different levels in different examples, depending on the time delay required between actuation and opening of the valve. Optionally fluid flow from the first chamber to the second chamber is directed through at least one restricting device, optionally a flow restrictor. Optionally fluid flow returning from the second chamber to the first chamber can bypass the restricting device, optionally by being directed through at least one one-way valve, optionally a check valve. Optionally at least one flow rate limiting device, which optionally allows fluid having flow rate less than a threshold value to flow in one direction, and optionally allows fluid to flow freely in the opposing direction, can be placed in line with the restricting device, e.g. upstream thereof. Optionally the flow rate limiting device can resist flow of fluid at flow rates above the threshold. Optionally the at least one flow rate-limiting device comprises a flow fuse such as are available from The Lee Company of USA or Lee Products of UK. Optionally at least one restricting device of larger size and/or lower pressure rating can be used in the case that at least one flow rate-limiting device is placed in line with the at least one restricting device.

Optionally the 'flow-fuse' may be employed in the activation cycle to restrict the pressure applied to the flow restrictor, acting as a pressure limiting non-return valve in the actuation flowpath i.e. it closes when a pressure above a set limit is applied to the 'forward' path, allowing relatively unrestricted flow in the reset cycle. This allows the resistance to fluid flow in the circuit during the actuation cycle to be significantly lower than without the 'flow-fuse', resistance to fluid flow during the reset cycle, being lowered to optionally $10^2$-$10^3$ times.

Optionally the first chamber contains a biasing device, optionally in the second sealed cavity of the first chamber. Optionally the biasing device is a resiliently biased device which optionally elastically deforms, optionally a spring. Optionally the biasing device biases the actuating device toward the first position.

Optionally the second chamber contains a biasing device, optionally in the sealed cavity of the second chamber. Optionally the biasing device is a resiliently biased device which optionally elastically deforms, optionally a spring. Optionally, the biasing device in the second chamber is a lower rating than the biasing device in the first chamber. Optionally the biasing device biases the closure member toward the open position. Optionally the action of the biasing device is counteracted by a hydraulic lock, optionally in the sealed cavity of the second chamber. Optionally the hydraulic lock is caused by fluid communication between the first and second chambers when the actuating device is in the first position. Optionally the hydraulic lock is released when the closure member is proximate to the open position. Optionally when the hydraulic lock is released, the closure member is biased by the biasing device alone, optionally biasing the closure member into the open position. Optionally when the hydraulic lock is released, the closure member is biased by well-bore pressure alone, optionally biasing the closure member into the open position. Optionally when the hydraulic lock is released, the closure member is biased by well-bore pressure in conjunction with the biasing device, optionally biasing the closure member into the open position.

Optionally the outer surface of the toe valve has at least one or more radially outwardly extending protrusions, optionally fins, which are optionally formed of a flexible material, optionally an elastomer such as rubber. Optionally a second sealed cavity of the second chamber contains another fluid, optionally a grease, optionally a gel. Optionally the actuation of the closure member drives the fluid, optionally through a fluid channel, to an external surface of the toe valve, optionally to an external surface of the at least one protrusions.

The various aspects of the present disclosure can be practiced alone or in combination with one or more of the other aspects, as will be appreciated by those skilled in the relevant arts. The various aspects of the disclosure can optionally be provided in combination with one or more of the optional features of the other aspects of the disclosure. Also, optional features described in relation to one aspect can typically be combined alone or together with other features in different aspects of the disclosure. Any subject matter described in this specification can be combined with any other subject matter in the specification to form a novel combination.

Various aspects of the disclosure will now be described in detail with reference to the accompanying figures. Still other aspects, features, and advantages of the present disclosure are readily apparent from the entire description thereof, including the figures, which illustrates a number of exemplary aspects and implementations. The disclosure is also capable of other and different examples and aspects, and its several details can be modified in various respects, all without departing from the spirit and scope of the present disclosure. Accordingly, each example herein should be understood to have broad application, and is meant to illustrate one possible way of carrying out the disclosure, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about". All singular forms of elements, or any other components described herein are understood to include plural forms thereof and vice versa.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
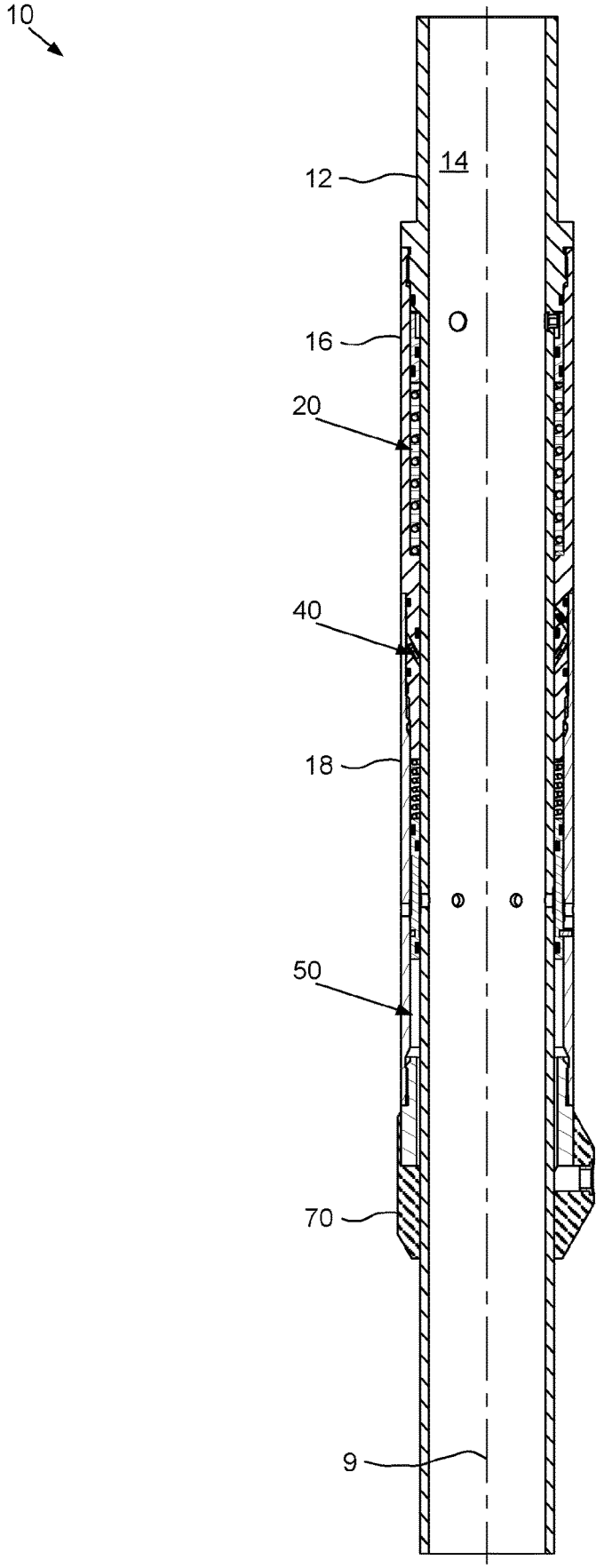
FIG. 1 is a section view of a first example of a toe valve comprising a body with a bore, shown in the closed configuration with the closure member in the closed position.

Referring now to the drawings, a first example of a toe valve 10 (also known as toe sleeve) is shown in FIG. 1. The toe valve 10 has a body which comprises an inner mandrel 12 having a bore 14 with an axis 9 and an outer surface on which other components are assembled. In this example the inner diameter of the bore 14 is constant, but in other examples the inner diameter of the bore could vary along its length. In this example the inner mandrel 12 is a tubular with a circular cross-section.

In this example an upper housing 16 and a lower housing 18 are assembled on the outer surface of the inner mandrel 12, by sliding over the inner mandrel 12. The upper housing 16 is connected to the inner mandrel 12 by screw threads, and the lower housing 18 is similarly connected to the upper housing 16. The upper housing 16 and lower housing 18 abut an external surface of the inner mandrel 12, and in this example the upper housing 16 and lower housing 18 are annular and surround the inner mandrel 12, but in other examples the upper housing 16 and lower housing 18 may not surround the inner mandrel 12, but may instead extend axially along a length of the inner mandrel 12 and have a narrow circumferential dimension. The upper housing 16 and lower housing 18 also extend axially along a length of an external surface of the inner mandrel 12, and in this example, the upper end of the lower housing 18 overlaps axially with the lower end of the upper housing 16.

In this example an axial portion of the upper housing 16 is radially spaced from the inner mandrel 12 to form an upper chamber 20. Also in this example, an axial portion of the lower housing 18 is radially spaced from the inner mandrel 12 to form a lower chamber 50. In this example, the upper chamber 20 and the lower chamber 50 are each annular and surround the inner mandrel 12. Also in this example, the radial depth of the upper chamber 20 and lower chamber 50 is constant along their axial length, and the upper chamber 20 and lower chamber 50 are axially spaced apart along the axis 9 of the bore 14.

A fluid channel 40 is disposed axially between the upper chamber 20 and lower chamber 50. In this example the fluid channel 40 is disposed in the axial region in which the upper end of the lower housing 18 overlaps axially with the lower end of the upper housing 16. The fluid channel 40 comprises a fluid channel cavity 44 (FIG. 2A) which in this example is disposed radially between the overlapping sections of the upper housing 16 and the lower housing 18. The fluid channel cavity 44 is disposed in a small radial recess in the radially outer surface of the upper housing 16. In this example fluid pathways of the fluid channel 40 are formed between a radially outer surface of the inner mandrel 12 and a radially inner surface of the upper housing 16, and are therefore not readily visible in the drawings due to their small dimensions. The fluid pathways connect the upper chamber 20 to the fluid channel cavity 44, and connect the lower chamber 50 to the fluid channel cavity 44. The fluid pathways allow fluid to bypass seals between the radially inner surface of the upper housing 16 and the radially outer surface of the inner mandrel 12, and between the radially outer surface of the upper housing 16 and the radially inner surface of the lower housing 18.

The inner mandrel 12 also comprises one or more lower fins 71 (FIG. 2B) mounted on a tail block 70 disposed on the lower end of the lower housing and secured thereto by a screw thread. In this example the fins 71 protrude radially outward from an outer surface of the tail block 70 at the lower end thereof, so that the radially outermost surface of the lower fins 71 have the greatest radial distance from the axis 9 of the bore 14 of any part of the toe valve 10. In this example there are six lower fins 71 spaced equidistantly around a circumference of an outer surface of the inner mandrel 12, but in other examples there may be fewer or more lower fins 71, and the lower fins 71 need not be spaced around the outer surface of the inner mandrel 12 equidistantly, regularly or symmetrically. In this example with lower fins 71 spaced equidistantly around the inner mandrel 12, the profile of the lower end of the toe valve 10 when viewed along the axis 9 of the bore 14 has a star-shaped appearance. In this example the axially opposing ends of the lower fins 71 taper radially inward toward the outer surface of the inner mandrel 12.

Figure 2A:
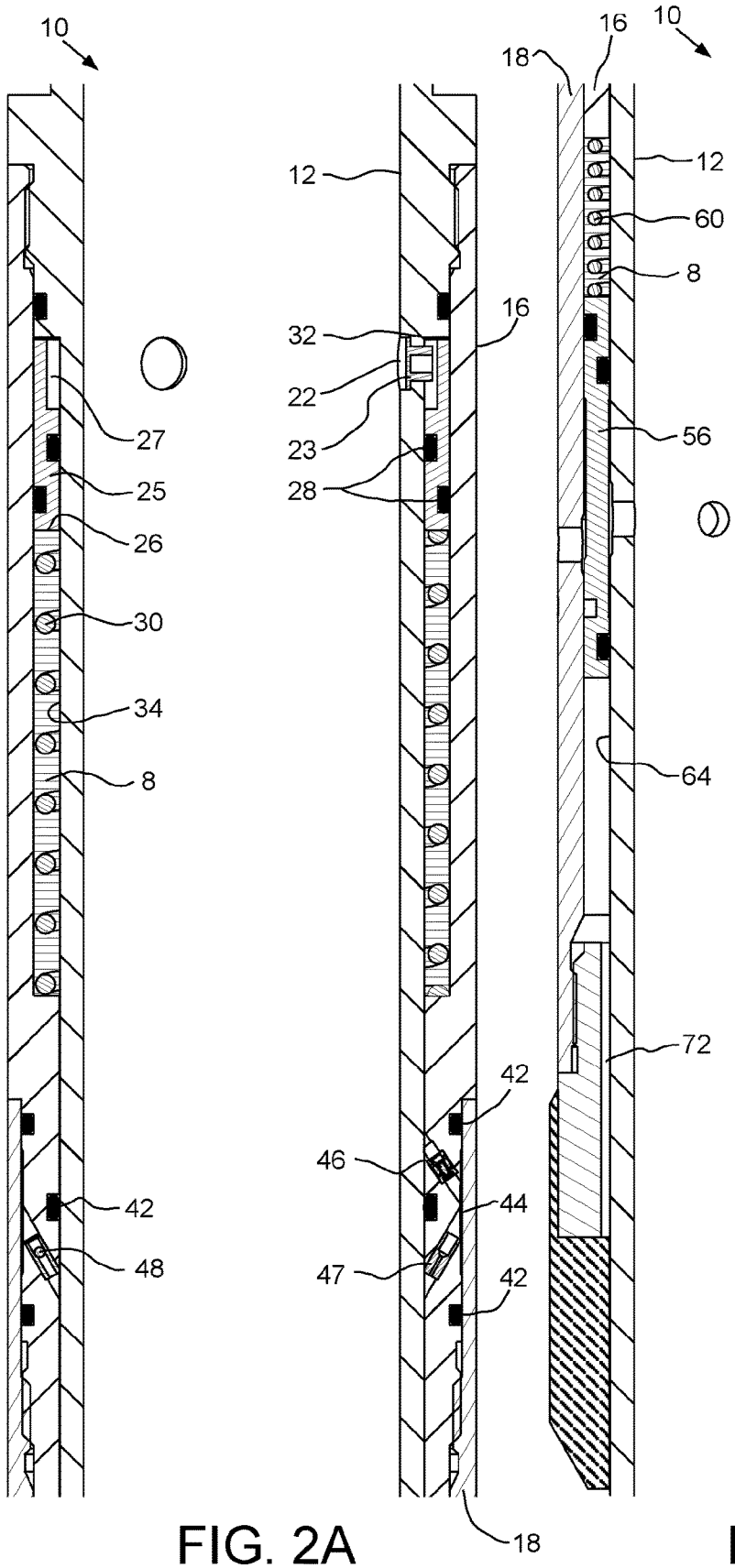
FIG. 2A is a detailed section view of the upper chamber and the fluid channel of the toe valve shown in FIG. 1.

The upper chamber 20 is shown in detail in FIG. 2A. The upper chamber 20 contains an actuating piston 25 and an actuating spring 30 forming part of the actuating mechanism. The actuating piston 25 moves axially in the upper chamber 20, and in this example the actuating piston 25 is an annular sleeve which surrounds the radially outer surface of the inner mandrel 12. Also in this example the actuating piston 25 has an actuating piston face 26 at one axial end, which is perpendicular to the axis 9 of the bore 14, and a radially recessed portion 27 in the radially inner surface at the opposing end of the actuating piston 25. The actuating piston 25 has a pair of actuating piston seals 28 on the radially outer and inner surfaces of the actuating piston 25 which make a fluid-tight seal against an outer surface of the inner mandrel 12 and an inner surface of the upper housing 16 within the upper chamber 20. In this example the actuating piston seals 28 are annular and surround the radially outer and inner surfaces of the actuating piston 25, and divide the upper chamber 20 into a bore cavity 32 and an upper spring cavity 34 which are isolated from each other. The bore cavity 32 is at the upper end of upper chamber 20 and the upper spring cavity 34 is at the lower end of upper chamber 20. As the actuating piston 25 moves axially through the upper chamber 20, the axial dimensions of the bore cavity 32 and the upper spring cavity 34 change with respect to each other. As the axial dimension of the bore cavity 32 increases, the axial dimension of the upper spring cavity 34 decreases in proportion, and vice versa.

The actuating piston spring 30 is disposed between a lower end of the upper spring cavity 34 and the actuating piston face 26. In this example, the actuating piston 25 can stroke axially between a first position at the upper end of the upper chamber 20, and a second position close to the lower end of the upper chamber 20 which is determined by the minimum axial length of the actuating spring 30 when in maximum compression.

The inner mandrel 12 has at least one aperture 22 between the bore 14 and the upper chamber 20. In this example apertures 22 are disposed equidistantly around a circumference of the inner mandrel 12, but in other examples the apertures 22 need not be spaced around the inner wall 16 equidistantly, regularly or symmetrically. Also in this example the apertures 22 are disposed at a common axial position axially proximate the upper end of the upper chamber 20. Also in this example the apertures 22 are approximately axially aligned with the recessed portion 27 of the actuating piston 25 when the actuating piston 25 is in its uppermost position at the upper end of the upper chamber 20. The apertures 22 optionally contain aperture excluders or covers, which in this example are burst disks 23, and which close off fluid communication between the bore 14 and the apertures 22 until the excluders or covers are opened.

The fluid channel 40 comprises fluid pathways formed between a radially outer surface of the inner mandrel 12 and a radially inner surface of the upper housing 16 which, as noted previously, are not readily visible in the drawings. The fluid pathways allow fluid communication between the upper spring cavity 34 of the upper chamber 20 and the lower spring cavity 62 of the lower chamber 50, through the flow channel cavity 44, and allow fluid to flow in either direction between the upper chamber 20 and the lower chamber 50. In this example the fluid circuit incorporates a flow rate limiting device in the form of a flow fuse 46, which allows flow of fluid at a flow rate less than a threshold value to flow in one direction, but which resists flow of fluid in the said one direction at flow rates greater than the threshold value. The flow fuse 46 is disposed between the lower end of the fluid pathway connected to the upper chamber 20 and the flow channel cavity 44. Also in this example, an actuation flowpath in the form of a flow restrictor 47 is disposed between the upper end of the fluid pathway connected to the lower chamber 50 and the flow cavity 44, and a reset flowpath in the form of a one-way check valve 48 is also disposed between the upper end of the fluid pathway connected to the lower chamber 50 and the flow cavity 44. Therefore, the flow restrictor 47 (forming the actuation flowpath) and the one-way check valve 48 (forming the reset flowpath, optionally together with the flow fuse 46) provide parallel fluid paths between the upper end of the fluid pathway connected to the lower chamber 50 and the flow cavity 44. The actuation pathway of the flow restrictor 47 and the reset pathway of the one-way check valve 48 are optionally disposed in a parallel arrangement, such that fluid flowing through the circuit in one direction can bypass one of them, and fluid flowing through the circuit in the opposite direction can bypass the other.

A fluid circuit is therefore formed by the upper and lower spring cavities 34, 62 linked by the flowpaths through the flow restrictor 47, flow fuse 46 and non-return valve 48. The fluid circuit has an actuation flowpath, comprising the flowpath through the flow restrictor 47, permitting a restricted flow of fluid from the upper cavity 34 to the lower spring cavity 62, and a reset flowpath, comprising the flowpath through the non-return valve, and optionally the flow fuse 46, each of which permit relatively unrestricted flow of fluid returning from the lower spring cavity 62 to the upper spring cavity 34. The resistance to fluid flow through the actuation flowpath and the reset flowpath are different, as will be explained below.

The fluid channel 40 further comprises fluid channel seals 42. In this example the fluid channel seals 42 comprise annular seals around the radially inner and radially outer surfaces of the upper housing 16. A pair of fluid channel seals 42 on the radially outer surface of the upper housing 16, axially spaced either side of the fluid channel cavity 44, isolates the fluid channel cavity 44 so that fluid can only flow through the fluid channel cavity 44 through any of the flow fuse 46, the flow restrictor 47 or the one-way check valve 48. A further fluid channel seal 42 on the radially inner surface of the upper housing 16, disposed in approximate axial alignment with the fluid channel cavity 44, isolates the upper spring cavity 34 of the upper chamber 20 from the lower spring cavity 62 of the lower chamber 50 and directs fluid flowing between the upper chamber 20 and the lower chamber 50 through the fluid channel cavity 44. The flow fuse 46 could be omitted in some examples, and simply serves to permit the system to work at lower pressures. In some examples, instead of a flow fuse, the fluid circuit could incorporate a pressure limiting device which allows flow of fluid at a pressure less than a threshold value to flow in one direction, but which resists flow of fluid in the said one direction at a pressure greater than the threshold value.

The flow fuse 46 acts as a pressure limiting non-return valve in the actuation flowpath i.e. it closes when a pressure drop (or flow rate) above a set limit is applied to the 'forward' path, restricting the pressure drop that can be applied across the flow restrictor, and hence the flow-rate through the restrictor. This allows the restrictor to have a larger bore without compromising its ability to contain the test pressures for the set duration without premature activation. In the reverse or reset cycle however, it allows relatively unrestricted flow allowing the system to reset in a relatively short time and/or under a lower pressure generated by the return-spring.

Figure 2B:
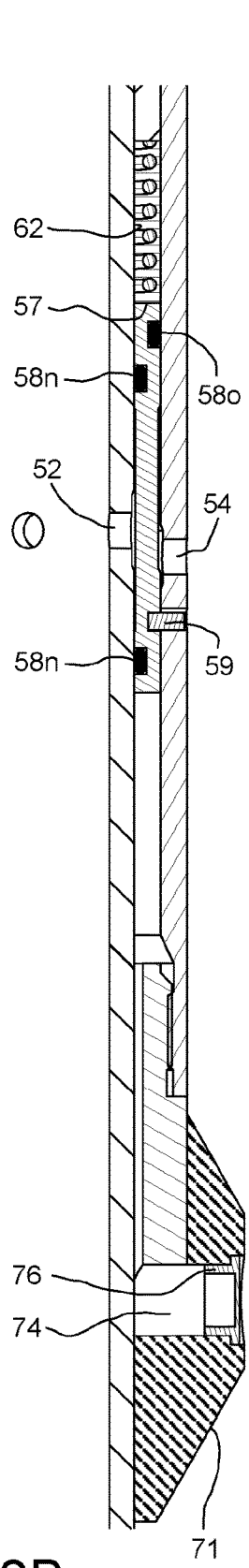
FIG. 2B is a detailed section view of the lower chamber of the toe valve shown in FIG. 1.

The lower chamber 50 is shown in detail in FIG. 2B. The lower chamber 50 contains a closure member 56 and a closure member spring 60. In this example the closure member spring 60 is less resilient than the actuating piston spring 30, and in other examples the closure member spring may not be present at all. The closure member moves axially in the lower chamber 50, and in this example the closure member 56 is an annular sleeve which surrounds the radially outer surface of the inner mandrel 12. Also in this example the closure member 56 has a closure member face 57 at one axial end, which in this example is perpendicular to the axis 9 of the bore 14. The closure member 56 is sealed within the lower chamber 50, and in this example, the closure member 56 optionally a pair of closure member seals **58*n* on the radially inner surface of the closure member 56 which make fluid-tight seals between the closure member and the outer surface of the of inner mandrel 12 above and below the inner port 52 passing through the inner surface of the inner mandrel 12, thereby effectively closing the inner port 52 when it is straddled by the axially spaced seals 58*n*. The closure member also has an outer seal 58*o* sealing between the outer surface of the closure member 56 and the inner surface of the lower housing 18, although other sealing arrangements can be provided. In this example the closure member seals 58***n,o* are annular and surround the radially outer and inner surfaces of the closure member 56, and divide the lower chamber 50 into a lower spring cavity 62 and a bullhead fluid cavity 64 which are isolated from each other. The lower spring cavity 62 is at the upper end of lower chamber 50 and the bullhead fluid cavity 64 is at the lower end of lower chamber 50. As the closure member 56 moves axially through the lower chamber 50, the axial dimensions of the lower spring cavity 62 and the bullhead fluid cavity 64 change with respect to each other: as the axial dimension of the lower spring cavity 62 increases, the axial dimension of the bullhead fluid cavity 64 decreases in proportion, and vice versa.

The closure member spring 60 is disposed between an upper end of the lower spring cavity 62 and the closure member face 57. In this example, the closure member 56 can stroke axially between a first position close to the upper end of the lower chamber 50 which is determined by the minimum axial length of the closure member spring 60 when in maximum compression, and a second position close to the lower end of the lower chamber 50 (for reasons that will be explained later). The closure member 56 is initially restrained in the first position by at least one fixing device, in this example at least one closure member shear pin 59 extending between shear pin pockets in the lower housing 18 and closure member 56 respectively or instead a groove in the lower housing.

The inner mandrel 12 has at least one inner port 52 between the bore 14 and the lower chamber 50. In this example the inner ports 52 are disposed equidistantly around a circumference of the inner mandrel 12, but in other examples the inner ports 52 need not be spaced around the inner mandrel 12 equidistantly, regularly or symmetrically. Also in this example the inner ports 52 are disposed at a common axial position axially approximately midway along the axial length of the lower chamber 50. Also in this example the inner ports 52 are approximately aligned with the axial midpoint of the closure member 56 when the closure member 56 is in its first position at the upper end of the lower chamber 50.

The lower housing 18 has at least one outer port 54 between the lower chamber 50 and an external surface of the toe valve 10. In this example the outer ports 54 are disposed equidistantly around a circumference of the lower housing 18, but in other examples the outer ports 54 need not be spaced around the lower housing 18 equidistantly, regularly or symmetrically. Also in this example the outer ports 54 are also disposed axially approximately midway along the length of the lower chamber 50, and so are approximately axially aligned with the inner ports 52.

In this example the inner ports 52 and outer ports 54 do not contain excluders, but in other examples, the inner ports 52 and outer ports 54 may contain excluders, which in those examples may be burst disks.

In this example the lower fins 71 are disposed axially adjacent to the lower end of the lower chamber 50 and are formed from a flexible or pliable material such as an elastomer such as rubber. Each lower fin 71 comprises a bullhead fluid channel 72 and a bullhead fluid channel port 74. The bullhead fluid channel port 74 is disposed on a radially outermost surface of the lower fin 71. In this example the bullhead fluid channel 72 is formed from a radially recessed portion of the inner surface of the upper end of the lower fin 71 which forms a narrow cavity between an external surface of the inner mandrel 12 and the inner surface of the lower fin 71. The bullhead fluid channel 72 links the bullhead fluid cavity 64 in the lower chamber 50 to the bullhead fluid port 74 of each lower fin 71. The bullhead fluid port 74 contains a bullhead fluid port excluder which in this example is an external rubber membrane burst disk 76.

In operation, the toe valve 10 is run into an oil or gas well on a string of tubulars, typically a casing or liner string, and typically at the lower end of the string. When the toe valve 10 has reached the required position in the oil or gas well, typically adjacent to an oil- or gas-bearing formation, the toe valve 10 is cemented into position in the well, typically by pumping cement down through the bore of the casing or liner string and back up the annulus between the casing or liner string and formation wall. Once the cement around the casing or liner string has hardened, the casing or liner string is typically subjected to a well pressure test to check the integrity of the casing or liner string in the well before further operations commence, e.g. to drill a further length of the well or to produce from the well.

The actuating piston 25 and the closure member 56 are shown in their initial positions in FIGS. 1, 2A, and 2B respectively, as they would be found after the toe valve 10 is run into the well. As the pressure in the bore 14 of the toe valve 10 is increased to the test pressure, the burst disk 23 in the aperture 22 of the upper chamber 20 will break or burst, allowing fluid communication between the bore 14 and the actuating piston recess 27 and bore cavity 32 of the upper chamber 20 and equalising the pressure between the bore 14 and the bore cavity 32. Pressurized bore fluid 7 enters the aperture 22 and exerts a fluid force on upper faces of the actuating piston 25.

Figures 3A, 3B, 3C:
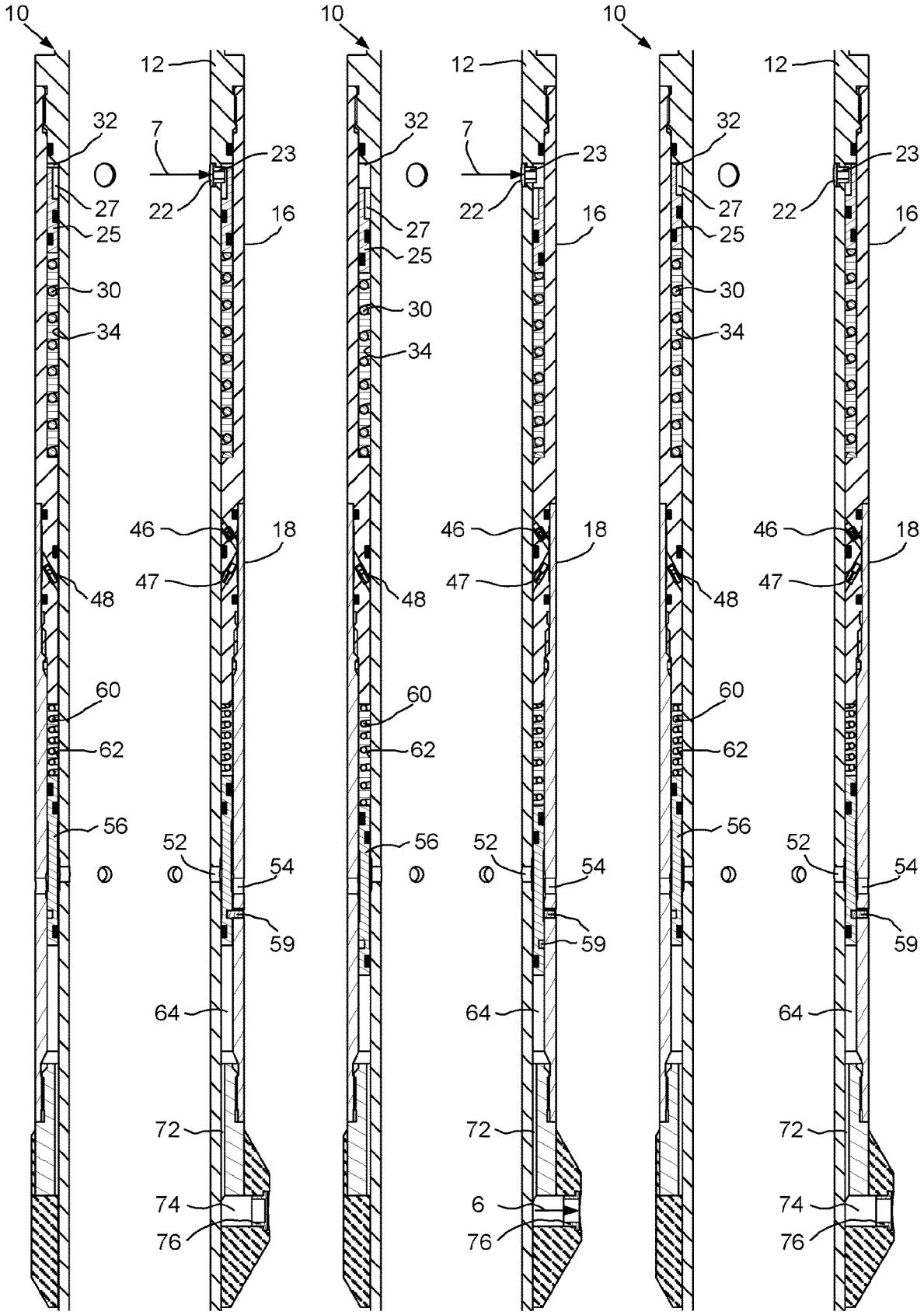
FIGS. 3A-3C, 4A, and 4B illustrate operation of the toe valve shown in FIG. 1.

As the pressure in the bore cavity 32 increases, the actuating piston 25 will start to move axially toward the lower end of the upper chamber 20 as shown in FIG. 3A, decreasing the volume of the upper spring cavity 34. Hydraulic fluid 8, such as refined and/or synthetic oil, in the fluid circuit is therefore driven from the upper spring cavity 34, through the fluid channel 40 and into the lower spring cavity 62, so increasing the pressure in the lower spring cavity 62. When the pressure in the lower spring cavity 62 exceeds the failure threshold of the closure member shear pin 59 in the pockets between the lower housing 18 and the closure member 56, the closure member shear pin breaks and releases the closure member 56, as shown in FIG. 3B, which is then able to move axially through the lower chamber 50, although because of the hydraulic lock effect of the hydraulic fluid 8 sealed in the fluid circuit between the spring cavities 34, 62, the axial movement of the closure member 56 is dependent on the flow rate through the flow restrictor 47, which is held to a relatively low rate, and hence, after initially releasing from the shear pin 59, the closure member 56 moves axially down the lower channel 50 at a slow and controlled rate, providing sufficient time for the performance of a pressure test.

While bore test pressure is maintained in the bore cavity 32 of the upper chamber 20, and with both the actuating piston 25 and closure member 56 free to move axially in the upper chamber 20 and lower chamber 50 respectively, the actuating piston 25 continues to move axially toward the lower end of the upper chamber 20. The volume of the bore cavity 32 continues to increase and the volume of the upper spring cavity 34 therefore continues to decrease. This drives hydraulic fluid 8 from the upper spring cavity 34 through the flow fuse 46 and into the fluid channel cavity 44. The hydraulic fluid 8 must then flow through the flow restrictor 47 to the lower spring cavity 62 since the hydraulic fluid cannot flow to the lower spring cavity 62 against the one-way check valve 48.

The flow restrictor 47 restricts the rate of hydraulic fluid flow through the flow channel 40 to the lower spring cavity 62, or in other words, the flow restrictor 47 places an upper limit on how quickly the hydraulic fluid 8 meters into the lower spring cavity 62. Therefore, the volume of fluid in the lower spring cavity 62 can only increase slowly. The axial position of the closure member 56 is hydraulically locked to the volume of fluid in the lower spring cavity 62; in other words, its axial displacement from the upper end of the lower chamber 50 is directly proportional to the volume of hydraulic fluid 8 in the lower spring cavity 62. Therefore, the time for the closure member 56 to move axially from its initial closed position to its open position is limited by the rate of flow of hydraulic fluid 8 through the flow restrictor 47 into the lower spring cavity 62, which in this example, is approximately equal to the duration of the well pressure test, typically at least 30 minutes, but of course the delay can be different in different examples.

As the closure member 56 moves axially towards its open position, the volume of the bullhead fluid cavity 64 decreases and drives bullhead fluid 6 from the bullhead fluid cavity 64 through the bullhead fluid channel 72 in the lower fin 71. As the pressure of bullhead fluid 6 in the bullhead fluid channel 72 increases, the bullhead fluid port burst disk 76 will break or burst and allow bullhead fluid to be forced out of the bullhead fluid port 74, where it will crack the cement surrounding the toe valve 10.

Referring to FIG. 3C, if the well pressure test is halted for any reason, for example if leaks are found during the test, the bore pressure in the bore cavity 32 of the upper chamber 20 will rapidly decrease. The pressure differential across the actuating piston 25 will therefore be reduced below a threshold at which the actuating piston spring 30 can return the actuating piston 25 to its first position. As the actuating piston 25 returns to its first position under the force of the spring 30, the volume of the upper spring cavity 34 increases and draws hydraulic fluid 8 back through the fluid channel 40 from the lower spring cavity 62. As the hydraulic fluid 8 leaves the lower spring cavity 62 it will flow mainly through the return fluid pathway through the one-way check valve 48 and fluid channel cavity 44 to the upper spring cavity 34 since the one-way check 48 valve has much lower resistance to fluid flow in the return direction than the flow restrictor 47, although return flow through the actuation side is theoretically possible, and fluid returning from the lower spring cavity 62 to the upper spring cavity 34 will also flow relatively freely through the flow fuse 46 as well as through the one-way check valve 48. The actuating piston 25 and the closure member 56 can therefore quickly return to their respective initial first and closed positions due to the free and rapid flow of fluid through the return fluid pathway of the fluid channel 40. In other words, during reset cycles, the direction of travel of the closure member 56 can be reversed. In this example the actuating piston 25 and the closure member 56 can return to their respective initial first and closed positions in approximately one or two minutes (at least ten times faster); in other examples the actuating piston 25 and the closure member 56 may return more quickly or more slowly in different examples.

Figure 4A:
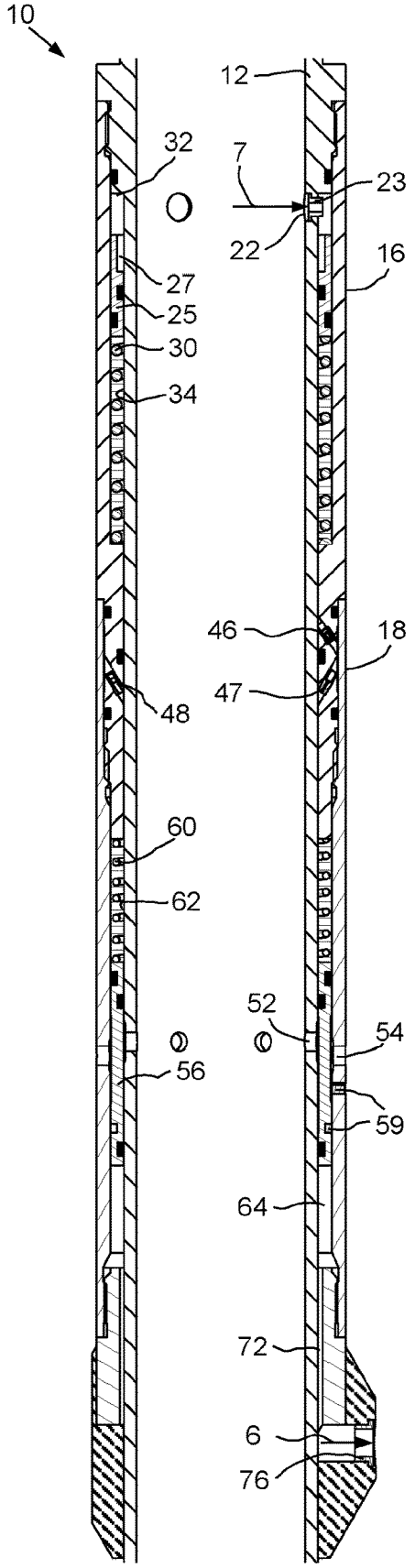
Figure 4B:
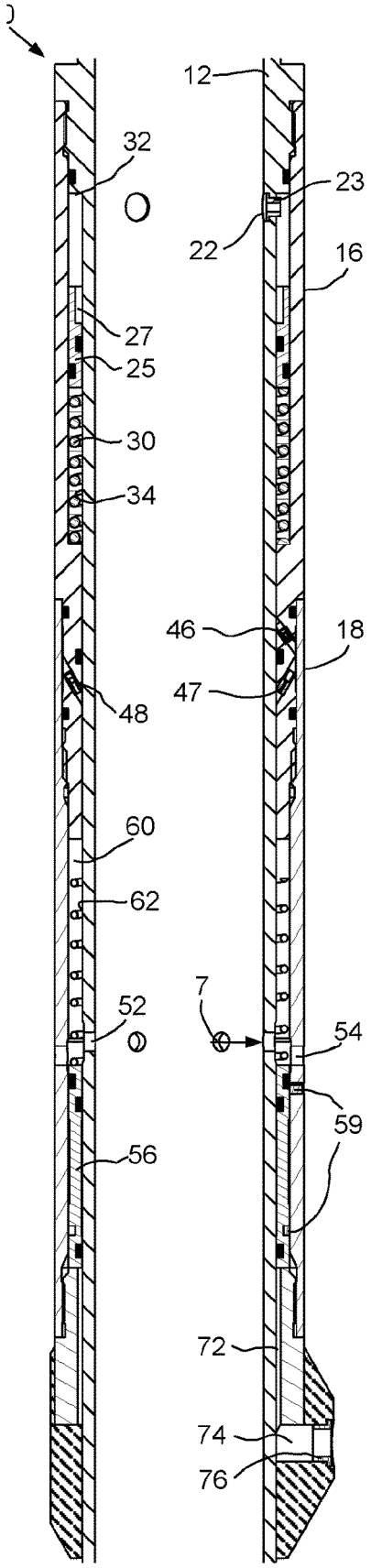

If the well pressure test is re-started, the actuating piston 25 and closure member 56 will again begin to move axially toward their respective second and open positions as described previously and as shown in FIG. 4A. If the well pressure test is allowed to run for its full duration, the closure member 56 will have moved close to its open position at the lower end of lower chamber 50. This position of the closure member 56 coincides with the delivery of most of the bullhead fluid 6, so the cement disruption operation is substantially complete at this stage. As the closure member 56 approaches its open position, the closure member 56 first moves past the axial position where the upper end of its inner seal 58 moves below the inner ports 52 of the inner mandrel 12, which opens the inner ports 52 and allows fluid communication between the bore 14 and the lower spring cavity 62. The pressure in the lower spring cavity 62 is therefore equalised with the pressure in the bore 14 and the hydraulic lock acting against the movement of the closure member 56 toward its open position is released. The closure member spring 60 then urges the closure member 56 quickly toward its open position, which moves the upper end of the closure member 56 past the axial position of the outer ports 54, which opens the outer ports and allows fluid communication between an external surface of the toe valve 10 and the lower spring cavity 62, as shown in FIG. 4B. The inner ports 52 and outer ports 54 are therefore in fluid communication, and the toe valve 10 is open to allow bore and/or formation fluids to pass between the bore 14 and the exterior of the toe valve 10.

An example of a partial actuation, reset and complete opening sequence will now be described specifically in reference to the first example of the toe valve 10. As pressure increases in the bore 14 during a well pressure test, the burst disk 23 will break or burst, allowing the bore fluid 7 at bore pressure to enter the actuation piston recess 27 through the aperture 22, and from there into the bore cavity 32 above the actuating piston 25. The actuating piston 25 will start to move axially toward the lower end of the upper chamber 20 but the closure member 56 is still held in position by the closure member shear pin 59. As the pressure in the bore 14 and bore cavity 32 continues to increase, the actuating piston 25 will continue to move axially, reducing the volume of the upper spring cavity 34. The pressure in the lower spring cavity 62 will also continue to increase as described previously, until the pressure exceeds the failure threshold of the closure member shear pin 59 which then shears, and the closure member 56 is then free to move axially through the lower chamber 50. As the closure member 56 moves axially through the lower chamber 50, the volume of the bullhead fluid cavity 64 decreases, which drives bullhead fluid through the bullhead fluid channel 72 and out of the bullhead fluid port 74.

If the well pressure test is halted, for example, because a leak is discovered, the assembly can be reset. Upon cessation of the pumps driving the pressure test, the pressure in the bore 14 and bore cavity 32 will rapidly decrease. The pressure differential across the actuating piston 25 will therefore reduce, allowing the actuating piston spring 30 to return the actuating piston 25 to its first position. As the actuating piston 25 returns to its first position, it draws fluid into the upper spring cavity 34 through the reset flowpath with the one-way check valve 48 in the fluid channel 40 from the lower spring cavity 62 as described previously, with minimal resistance to fluid flow through the reset flowpath, and through the flow fuse 46, which permits relatively unrestricted flow to fluid flowing in the reset cycle. While the flow restrictor 47 remains open and fluid can theoretically flow through it in the return cycle, the flow restrictor 47 still has much higher resistance to fluid flow than the reset pathway provided by the one-way check valve 48 (and optionally the flow fuse 46), so substantially all of the fluid returning from the lower spring cavity 62 to the upper spring cavity 34 flows through the reset flowpath provided by the one-way check valve 48 (and optionally the flow fuse 46) rather than through the flow restrictor. As there is a hydraulic lock between the upper and lower spring cavities 34, 62, the closure member 56 also returns to its initial closed position.

When the well pressure test is re-started and the pressure again increases in the bore 14 and bore cavity 32, the actuating piston 25 and closure member 56 will again begin to move axially toward their respective second and open positions. If the well pressure test runs for its normal duration, the actuating piston 56 will reach its second position after driving a majority of the fluid in the upper spring cavity 34 through the flow restrictor 47 in the fluid channel 40 into the lower spring cavity 62. As the closure member 56 is driven axially toward its open position by the increasing pressure of fluid in the lower spring cavity 62, the upper end of the inner seal **58*n* of the closure member 56 will eventually move past the axial position of the inner ports 52, allowing fluid communication between the bore 14 and the lower spring cavity 62. The hydraulic lock in the lower spring cavity 62 is at that point released, allowing the combined forces of the pressure differential and the closure member spring 60 to urge the closure member 56 quickly into its open position. As it moves toward the open position, the upper end of the closure member 56 moves down past the axial position of the outer ports 54, which allows fluid flow between the inner ports 52 of the bore 14, and the outer ports 54 on the exterior of the toe valve 10**. Fluid can then be pumped through the bore of the assembly into the formation.

Advantageously, the toe valve 10 can be reset to allow a complete second pressure test if the first pressure test fails. For the prior art toe sleeve, if a pressure test needs to be interrupted part-way through to check or resolve any identified anomalies, the toe sleeve will re-commence its actuation sequence in response to re-applied well test pressure of a second or subsequent pressure test, but only for any remaining 'balance' of time by which the initial pressure test was shortened. For example, if the prior art toe sleeve is set for a 30 minute pressure test, but the test is interrupted after 20 minutes, the toe sleeve will open only 10 minutes into a second pressure test.

While the foregoing is directed to embodiments of the present disclosure, other and further embodiments of the disclosure may be devised without departing from the basic scope thereof, and the scope of the invention is determined by the claims that follow.

The invention claimed is:

1. A toe valve to control the injection of fluid into a toe of an oil or gas well, the toe valve comprising:

a body with a bore, the body having a port adapted to permit fluid flow between the bore and an outlet on an external surface of the toe valve when the port is open;

a closure member adapted to move from an initial closed position in which the port is closed, to an open position in which the port is open; and an actuating mechanism which can be actuated to urge the closure member from the initial closed position toward the open position, and which can be reset when the closure member is moving between the closed and open positions to return the closure member to the initial closed position, wherein the actuation mechanism comprises a fluid circuit for applying a pressure differential to move the closure member, wherein the fluid circuit has an actuation flowpath and a reset flowpath, wherein fluid flows through the actuation flowpath when the closure member is moving toward the open position, wherein the fluid flows through the reset flowpath when the closure member is moving toward the closed position, and wherein the actuation flowpath has a higher resistance to fluid flow than the reset flowpath.

2. The toe valve as claimed in claim 1, wherein the actuation mechanism is adapted to apply a pressure differential acting on the closure member in more than one direction.

3. The toe valve as claimed in claim 1, wherein the reset flowpath incorporates a non-return valve.

4. The toe valve as claimed in claim 1 wherein the actuation flowpath incorporates a flow restrictor.

5. The toe valve as claimed in claim 1, wherein the fluid circuit incorporates a flow rate limiting device, which allows flow of fluid at a flow rate less than a threshold value to flow in one direction, but which resists flow of fluid in the said one direction at flow rates greater than the threshold value.

6. The toe valve as claimed in claim 5, wherein the flow rate limiting device is arranged in line with the flow restrictor and is upstream thereof.

7. The toe valve as claimed in claim 1, wherein the fluid circuit incorporates a pressure limiting device, which allows flow of fluid at a pressure less than a threshold value to flow in one direction, but which resists flow of fluid in the said one direction at a pressure greater than the threshold value.

8. The toe valve as claimed in claim 1, wherein the actuation flowpath and the reset flowpath are disposed in a parallel arrangement, such that fluid flowing through the fluid circuit in one direction can bypass one of the actuation and reset flowpaths, and fluid flowing through the fluid circuit in the opposite direction can bypass the other.

9. The toe valve as claimed in claim 1, wherein the closure member is biased toward the open position by a resilient biasing device.

10. The toe valve as claimed in claim 1, wherein:

the actuation mechanism further comprises an actuating piston operable to pressurize the fluid circuit, and the closure member is hydraulically locked to the actuating piston.

11. The toe valve as claimed claim 10, wherein the hydraulic lock is released when the closure member is in the open position.

12. A toe valve as claimed claim 10, wherein:

the actuating piston is movable between a first position and a second position, the closure member moves toward the closed position as the actuating piston moves toward the first position, the actuation mechanism comprises an actuating piston spring, and the actuating piston spring is operable to return the actuating piston to its first position.

13. The toe valve as claimed in claim 1, wherein the toe valve has at least one protrusion extending radially outwardly from an external surface of the toe valve, and wherein the closure member is adapted to drive a fluid through an aperture in the at least one protrusion.

14. A toe valve adapted for assembly into a string of tubulars, for use in an oil or gas well, the toe valve comprising an inner wall surrounding a bore of the toe valve and an outer wall, a first chamber disposed between the inner wall and the outer wall, with an aperture through the inner wall between the first chamber and the bore, wherein the first chamber has an actuating device resiliently biased in a first configuration and adapted to be movable by fluid pressure in the bore toward a second configuration, a second chamber disposed between the inner wall and the outer wall and axially spaced from the first chamber, wherein the second chamber has a closure member adapted to be actuated from a first configuration toward a second configuration, wherein the closure member permits fluid access between the bore and the external surface of the toe valve when in the second configuration, wherein the actuating device urges fluid from the first chamber to the second chamber when moving toward its second configuration, and urges fluid from the second chamber to the first chamber when moving toward its resiliently biased first configuration, wherein fluid flow from the first chamber to the second chamber actuates the closure member toward its second configuration, and wherein fluid flow from the second chamber to the first chamber actuates the closure member toward its first configuration, and wherein resistance to fluid flow from the first chamber to the second chamber is greater than resistance to fluid flow from the second chamber to the first chamber.

15. A toe valve to control the injection of fluid into a toe of an oil or gas well, the toe valve comprising:

a body with a bore, the body having a port adapted to permit fluid flow between the bore and an outlet on an external surface of the toe valve when the port is open;

a closure member adapted to move from an initial closed position in which the port is closed, to an open position in which the port is open; and an actuating mechanism which can be actuated to urge the closure member from the initial closed position toward the open position, and which can be reset when the closure member is moving between the closed and open positions to return the closure member to the initial closed position, wherein the actuation mechanism comprises a fluid circuit for applying a pressure differential to move the closure member, wherein the actuation mechanism comprises an actuating piston operable to pressurize the fluid circuit, wherein the closure member is hydraulically locked to the actuating piston, and wherein the hydraulic lock is released when the closure member is in the open position.

16. A toe valve as claimed claim 15, wherein:

the actuating piston is movable between a first position and a second position, the closure member moves toward the closed position as the actuating piston moves toward the first position, the actuation mechanism comprises an actuating piston spring, and the actuating piston spring is operable to return the actuating piston to its first position.

* * * * *